US007292127B2

(12) United States Patent
Yamashita et al.

(10) Patent No.: US 7,292,127 B2
(45) Date of Patent: Nov. 6, 2007

(54) TRANSFORMER

(75) Inventors: Kouji Yamashita, Nagareyama (JP); Youji Matsuda, Arakawa (JP); Kazuo Nishiyama, Nakajo (JP); Masao Hosokawa, Nakajo (JP); Kazuyuki Fukui, Nakajo (JP); Hidemasu Yamaguchi, Nakajo (JP); Tooru Honma, Shibata (JP); Hiroyuki Endou, Agano (JP); Makoto Shinohara, Nakajo (JP)

(73) Assignee: Hitachi Industrial Equipment Systems Co., Ltd., Chiba (JP)

( * ) Notice: Subject to any disclaimer, the term of this patent is extended or adjusted under 35 U.S.C. 154(b) by 101 days.

(21) Appl. No.: 11/138,234

(22) Filed: May 25, 2005

(65) Prior Publication Data

US 2005/0280491 A1 Dec. 22, 2005

(30) Foreign Application Priority Data

May 26, 2004 (JP) ..... 2004-156412
Dec. 17, 2004 (JP) ..... 2004-365872
Dec. 24, 2004 (JP) ..... 2004-372408

(51) Int. Cl.
*H01F 27/24* (2006.01)

(52) U.S. Cl. ..... 336/216; 336/234; 336/213

(58) Field of Classification Search ..... 336/213, 336/216, 217, 234
See application file for complete search history.

(56) References Cited

U.S. PATENT DOCUMENTS 4,814,736 A * 3/1989 Lee et al. ..... 336/213
4,972,573 A * 11/1990 Yamamoto et al. ..... 29/609
5,055,815 A * 10/1991 Yamamoto et al. ..... 336/196
5,398,403 A * 3/1995 Freeman ..... 29/609
6,668,444 B2 * 12/2003 Ngo et al. ..... 29/606

FOREIGN PATENT DOCUMENTS

JP 06-084656 3/1994
JP 09-007849 1/1997
JP 09-237719 9/1997
JP 09-246057 9/1997
JP 11-008147 1/1999
JP 2002-083716 3/2002

* cited by examiner

*Primary Examiner*—Anh Mai
(74) *Attorney, Agent, or Firm*—Townsend and Townsend, and Crew LLP

(57) ABSTRACT

There is provided a joint structure of a wound iron core in which iron core characteristics can be enhanced by improving the distribution of magnetic flux within an iron core. A wound iron core is formed to provide a joining structure or a butt joining structure and a lap joining structure disposed in an appropriate arrangement in which the a margin of overlapping is more increased as being closer to an outer periphery from an inner periphery of the iron core, taking a distribution of magnetic flux density within the iron core into consideration.

6 Claims, 10 Drawing Sheets

TRANSFORMER

INCORPORATION BY REFERENCE

The present application claims priorities from Japanese applications JP2004-156412 filed on May 26, 2004, JP2004-365872 filed on Dec. 17, 2004, JP2004-372408 filed on Dec. 24, 2004, the contents of which are hereby incorporated by reference into this application.

BACKGROUND OF THE INVENTION

The present invention relates to a construction of a transformer and particularly, to a structure of an iron core.

The prior art techniques associated with the present invention are disclosed in, for example, JP-A-6-84656 and JP-A-9-7849. JP-A-6-84656 discloses a technique relating to a process for producing a wound iron core using a thin band of an amorphous alloy, and a joining structure of the wound iron core. JP-A-9-7849 discloses a technique relating to a process for producing a wound iron core having a lap joining (overlapping) configuration as a basic joining structure using a thin band of an amorphous alloy, and a joining structure.

In the conventional wound iron core, the magnetic flux density is higher in an inner side of the iron core, and more decreased as closer to an outer periphery, due to a difference between inner and outer magnetic paths defined by an iron core material. For this reason, a strain of a magnetic flux waveform due to the concentration of a magnetic flux is produced to generate an abnormal loss, and thus the deterioration of characteristics is not avoided.

SUMMARY OF THE INVENTION

It is an object of the present invention to improve the distribution of magnetic flux within an iron core of a transformer, thereby provide an improvement of iron core characteristics.

According to the present invention, the lap margin in a joint area can be increased with the lamination of each unit (or layer) of the iron core, or a butt joining structure and a lap joining structure can be disposed appropriately, so that the magnetic resistance on an outer peripheral side can be reduced more than that in the conventional wound iron core, thereby moderating the difference between magnetic flux densities on the inner and outer peripheries of the iron core.

Other objects, features and advantages of the invention will become apparent from the following description of the embodiments of the invention taken in conjunction with the accompanying drawings.

DETAILED DESCRIPTION OF THE INVENTION

The best mode for carrying out the present invention will now be described with reference to the drawings.

Figure 1:
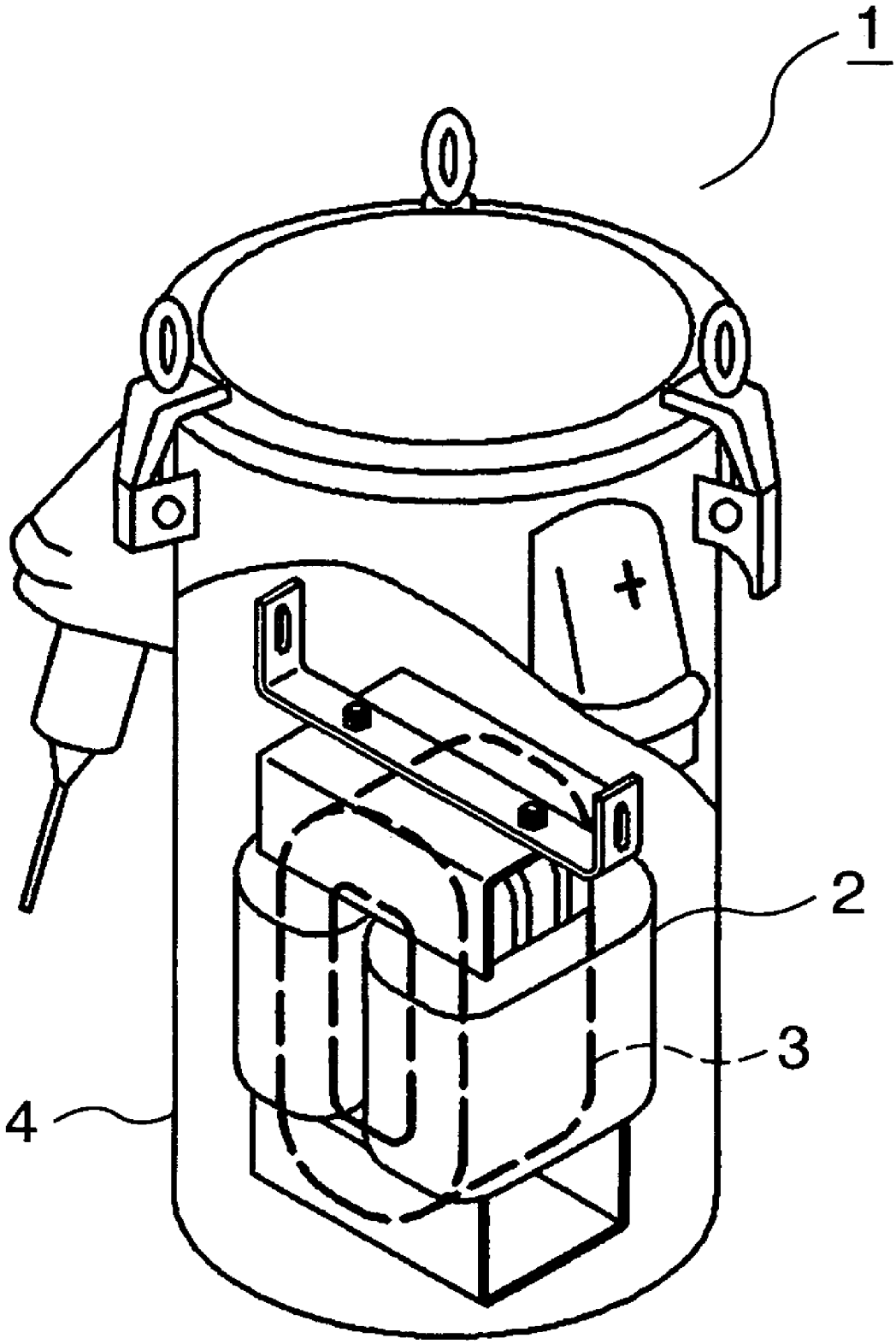
FIG. 1 is a view of an example of an arrangement of a transformer as a first embodiment of the present invention.
Figure 2:
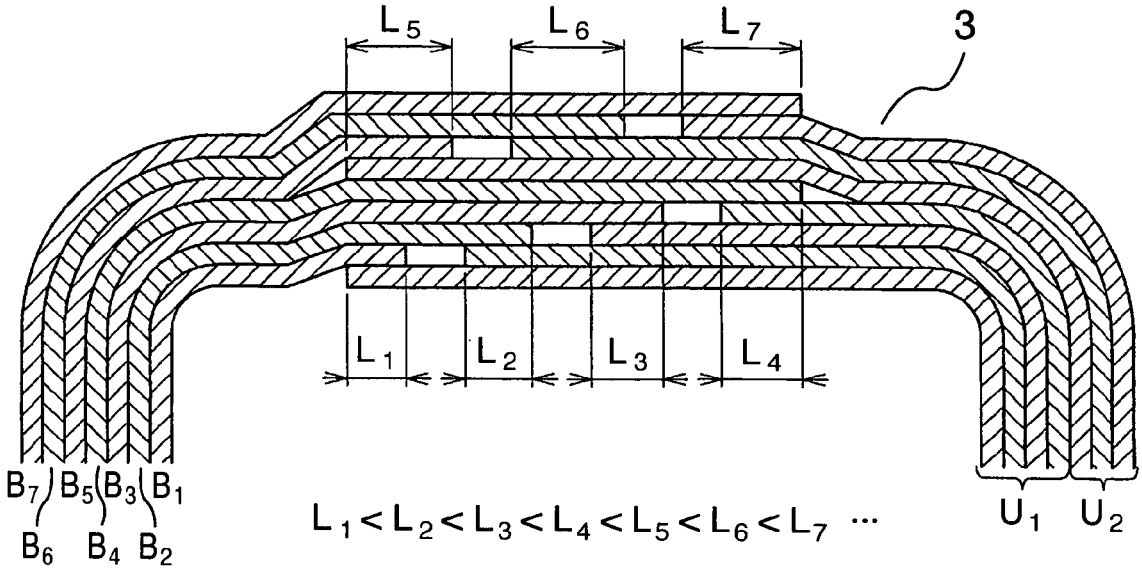
FIG. 2 is a diagram of a sectional arrangement of an iron core used in the transformer.

FIGS. 1 to 3 are illustrations of a first embodiment of the present invention. FIG. 1 is a view of an example of an arrangement of a transformer according to the first embodiment of the present invention; FIG. 2 is a structural view of a joint section of an iron core used in the transformer shown in FIG. 1; and FIG. 3 is a diagram for explaining a distribution of magnetic flux within the iron core.

In FIG. 1, the numeral 1 denotes a transformer; 2 an exciting coil for forming an electric circuit; 3 a wound iron core for forming a magnetic circuit; and 4 a container for mechanically protecting the transformer. The iron core 3 comprises a plate-shaped magnetic material, for example, on the order of $0.02\times10^{-3}$ m to $0.60\times10^{-3}$ m, laminated annularly into a plurality of layers. The plate-shaped magnetic material laminated into the plurality of layers is overlapped at its opposite ends onto each other and thus formed into an annular shape.

FIG. 2 is a diagram showing an arrangement of a section in a joint area of the wound iron core 3 used in the transformer.

In FIG. 2, the numeral 3 denotes the wound iron core; the symbols $B_1$, $B_2$, - - - , $B_N$ denote first layers formed by the plate-shaped magnetic material forming the wound iron core; $U_1$, $U_2$, - - - , $U_N$ second layers formed by laminating the magnetic material while offsetting the first layer $B_N$ in a winding direction; and $L_N$ a length (in a winding direction) of mutual lapping of opposite ends of the first layer $B_N$ in the joint area of the wound iron core 3. In the case, N means that the layer is disposed at an N-th location (N =1, 2, 3, - - - ) from an innermost periphery of the wound iron core.

The first layer $B_N$ is formed so that the margin $L_N$ of overlapping of its opposite ends is increased. Therefore, it is possible to suppress an increase in a magnetic resistance to an increment in length of a magnetic path on an outer peripheral side to increase the magnetic flux density on the outer peripheral side, as compared with a conventional wound iron core.

Numeral values representing iron core characteristics includes an iron loss, but when a joining structure of the wound iron core is formed ideally in a manner 100% similar to that in the above-described embodiment, the iron loss is minimal. However, the following is conventionally known: Even when other joining structures (e.g., a butt step-lap type or an overlap type) are used in combination in a lap area, the iron loss is increased, but the increase tendency is necessarily not proportional to the number of joints and is affected by the jointing structure and the disposition of the joining type. Therefore, if preferably one half or more of the number of all joints assumes the joining structure shown in the first embodiment, the iron core has iron core characteristics substantially equivalent to those in the first embodiment.

Figure 3A:
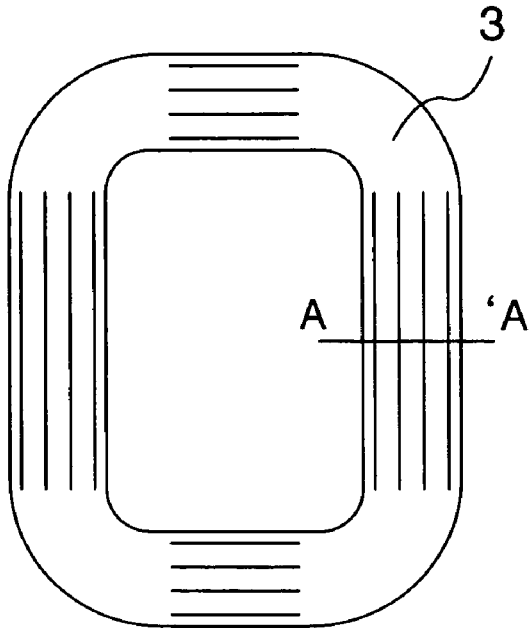
FIG. 3A is a schematic view of a conventional iron core.
Figure 3B:
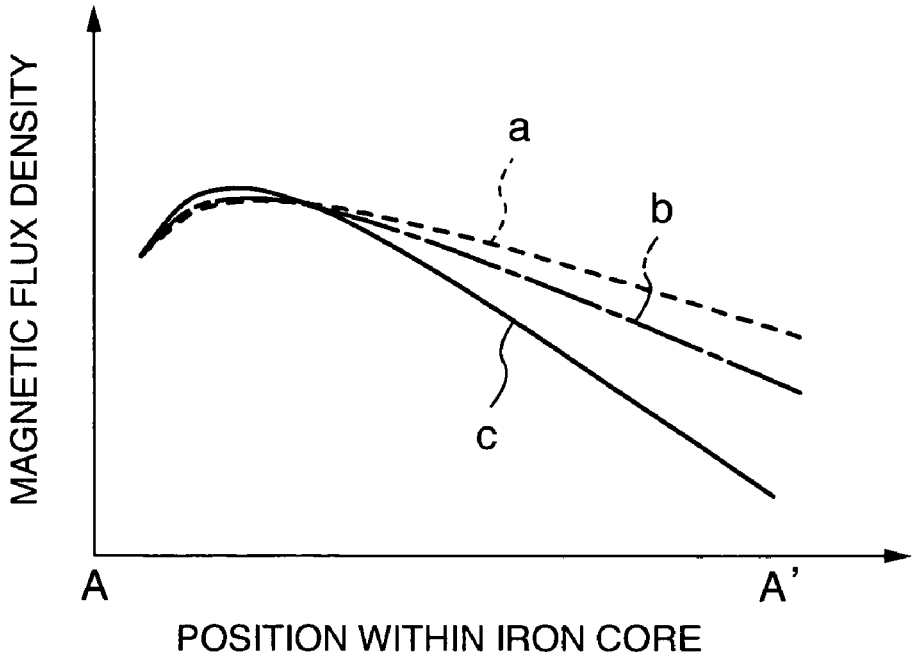
FIG. 3B is a diagram for explaining a distribution of magnetic flux within the iron core.

FIG. 3A is an explanatory view of a conventional wound iron core, and FIG. 3B is a diagram of a distribution of magnetic flux within the wound iron core.

Figure 4:
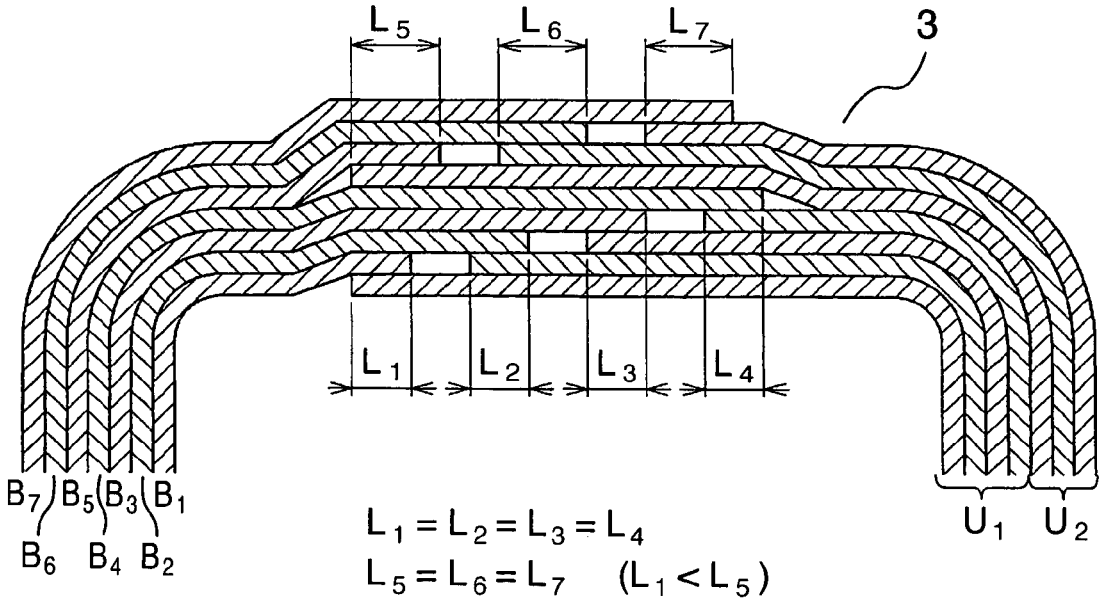
FIG. 4 is an explanatory view of a second embodiment of the present invention.

In FIG. 3B, a indicates a characteristic of a distribution of magnetic flux in a section of A-A' within the wound iron core 3 in FIG. 2 showing the first embodiment; b indicates a characteristic of a distribution of magnetic flux in a section of A-A' within a wound iron core 3 in FIG. 4 showing a second embodiment; and c indicates a characteristic of a distribution of magnetic flux in a section of A-A' in the conventional wound iron core. In the first embodiment, an increase in a magnetic resistance is moderated, whereby the magnetic flux density on the outer peripheral side can be maintained higher, as shown by the characteristic a. Therefore, the distribution of magnetic flux within the iron core is more uniform than that in the conventional wound iron core, and hence, the iron core characteristics can be enhanced.

FIG. 4 is an explanatory view of the second embodiment of the present invention, showing a construction of a joint section of a wound iron core 3 used in a transformer according to the second embodiment.

In FIG. 4, as in FIG. 2, the numeral 3 denotes the wound iron core; the symbols $B_1$, $B_2$, - - - , $B_N$ denotes first layers formed by the plate-shaped magnetic material forming the wound iron core; $U_1$, $U_2$, - - - , $U_N$ are second layers formed by laminating the magnetic material while offsetting the first layer $B_N$ in a winding direction; and $L_N$ is a length (in a winding direction) of mutual lapping of opposite ends of the first layer $B_N$ in the joint area of the wound iron core 3. The second embodiment has the structure such that the length $L_N$, in a winding direction, of mutual lapping of opposite ends of the first layer $B_N$ has the same lap margin $L_N$ within the same second layer $U_N$, but the lap margin $L_N$ is increased from an inner peripheral layer toward an outer peripheral layer. In the second embodiment, an increase in the lap margin $L_N$ from the inner periphery toward the outer periphery ensures that an increase in magnetic resistance on the outer peripheral side in the laminating direction is suppressed as compared with the conventional wound iron core, and a difference in magnetic flux density between the inner and outer peripheries of the iron core is more uniform than that in the conventional wound iron core, and hence, it is possible to increase an average magnetic flux density of the entire wound iron core. Thus, it is possible to provide a joining structure in which the amount of magnetic material used can be suppressed to the minimum to realize a high efficiency of a joining operation by improving the iron core characteristics and, at the same time, uniformizing the lap margin $L_N$ within the same unit.

In the second embodiment, as in the first embodiment, it is desirable that preferably one half or more of the number of all joints is a similar to the joints in the above-described embodiment.

It should be noted in the first and second embodiment that the lap margin $L_N$ of the first layer $B_N$ is optimal to be in a range of 1 mm$\leqq L_N \leqq$250 mm based on the capacity of the transformer in a range of 5 kVA to 2,000 kVA. It is ideal that the lap margin $L_1$ in the innermost peripheral first layer $B_1$ is equal to 0 ($L_1$=0), but, if the real producing process and the fabrication accuracy are taken into consideration, it is preferable that $L_1$ is equal to or larger than 1 mm. When the capacity of the transformer is increased, the wound iron core itself is also increased, and the ratio of $L_N$ on the outermost peripheral side to the length of the magnetic path on the outermost peripheral side is decreased, and hence, the effect of uniformizing the difference in magnetic flux density is lessened. Therefore, it is preferable that if the actual workability and the cost balance are taken into consideration, $L_N$ on the outermost peripheral side is suppressed to about 250 mm.

Figure 5:
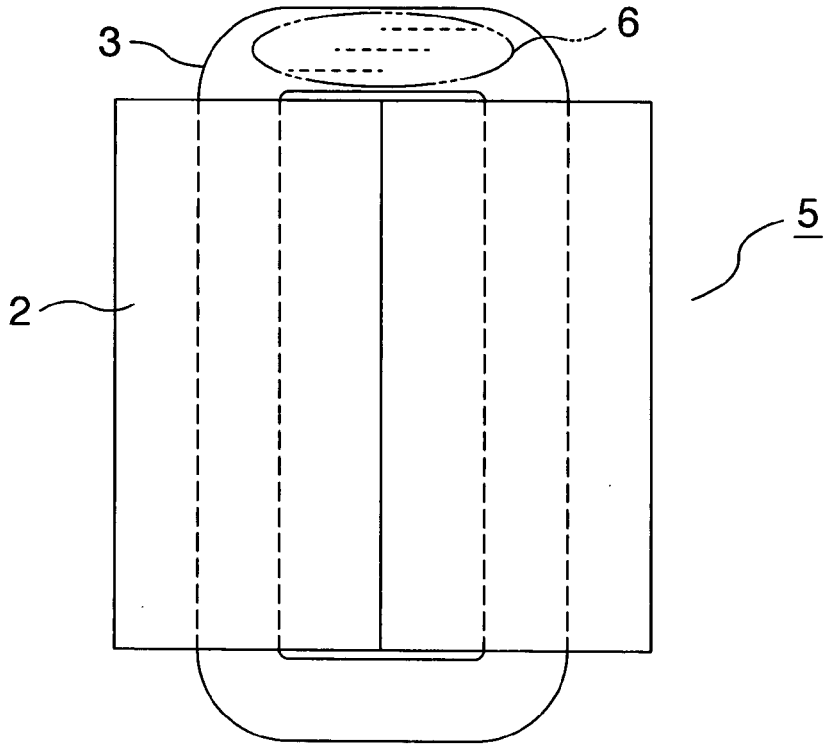
FIG. 5 is an explanatory view of a third embodiment of the present invention.

FIG. 5 is an explanatory view of the relationship between a wound iron core and a coil constituting a transformer according to a third embodiment of the present invention.

In FIG. 5, the numeral 5 indicates that the relationship between a coil and an iron core is of an inner iron configuration; the numeral 2 denotes an exciting coil; 3 a wound iron core; and 6 a lap portion of the wound iron core. In the third embodiment, the lap portion of the iron core is disposed outside the limit of the exciting coil and hence, it is easy to carry out a lapping operating. In addition, because of the inner iron configuration, the iron core has one leg, and the time required for the lapping operation is shorter. In this way, in the third embodiment, it is possible to enhance the iron core characteristics and to greatly reduce the operating or working time.

Figure 6:
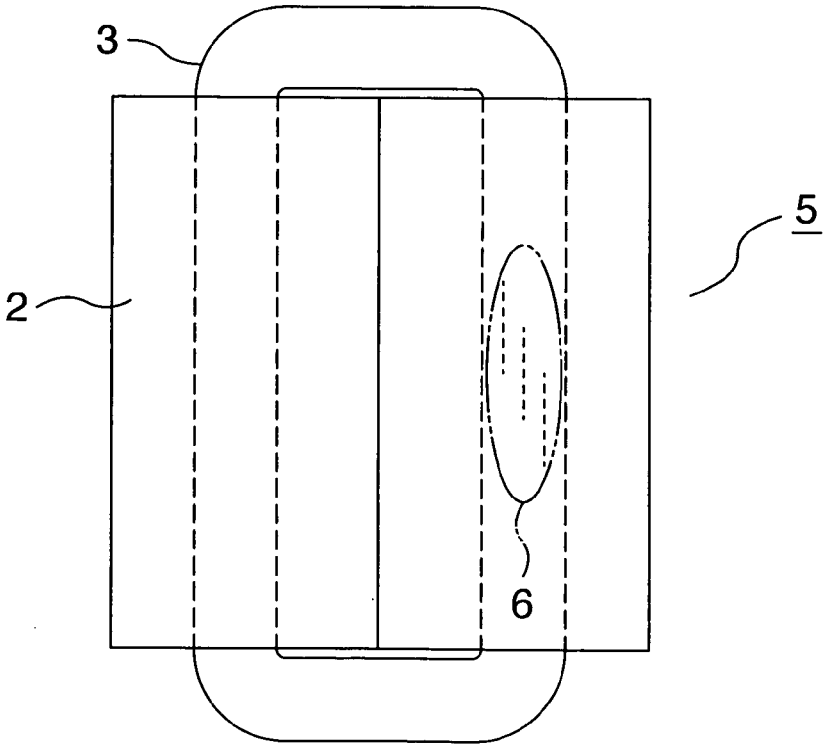
FIG. 6 is an explanatory view of a fourth embodiment of the present invention.

FIG. 6 is an explanatory view of the relationship between a wound iron core and a coil constituting a transformer according to a third embodiment of the present invention.

In FIG. 6, the numeral 5 indicates that the relationship between a coil and an iron core is of an inner iron configuration; the numeral 2 denotes an exciting coil; 3 a wound iron core; and 6 a lap portion of the wound iron core. In the fourth embodiment, the lap portion of the iron core is disposed inside the frame of the exciting coil. For this reason, it is difficult to carry out a lapping operation, while it is possible to reduce the height dimension of the iron core by about 5%. In this way, in the fourth embodiment, it is possible to enhance the iron core characteristics and to realize the compactness of the transformer.

Figure 7:
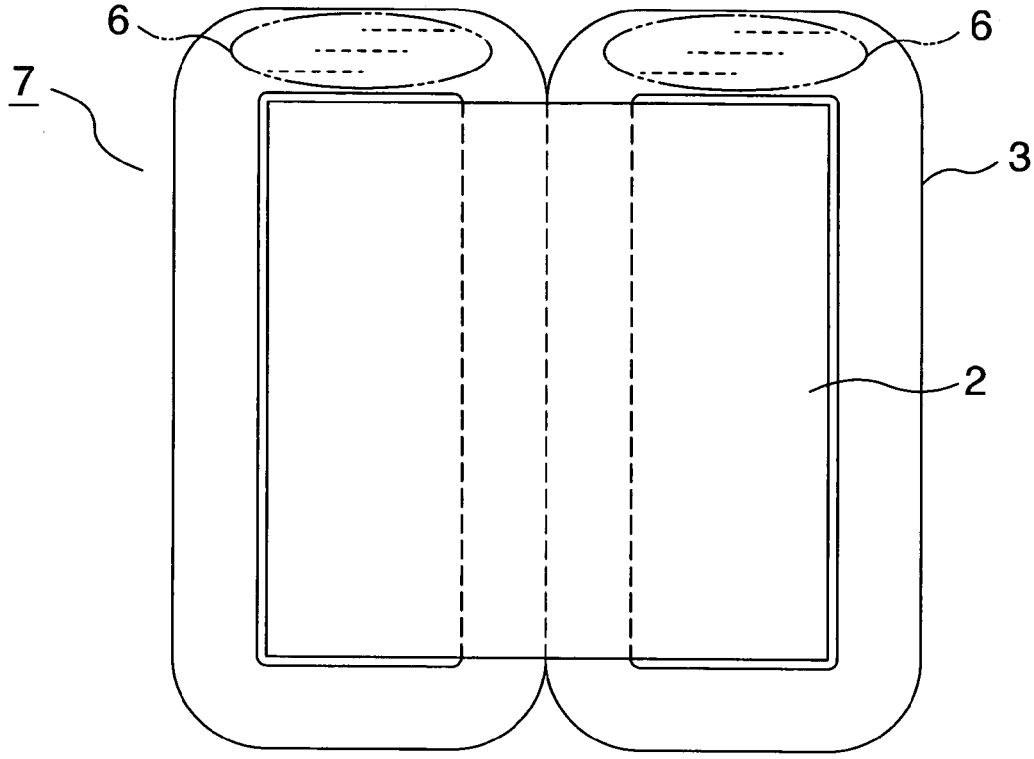
FIG. 7 is an explanatory view of a fifth embodiment of the present invention.

FIG. 7 is an illustration of the relationship between a wound iron core and a coil constituting a transformer according to a fifth embodiment of the present invention.

In FIG. 7, the numeral 7 indicates that the relationship between a coil and a wound iron core is of an outer iron configuration; the numeral 2 denotes an exciting coil; 3 a wound iron core; and 6 a lap portion of the wound iron core. In the fifth embodiment, the lap portion of the iron core is disposed outside the frame of the exciting coil. For this reason, it is easy to carry out a lapping operation, and there is a large effect of shortening the operating or working time.

Figure 8:
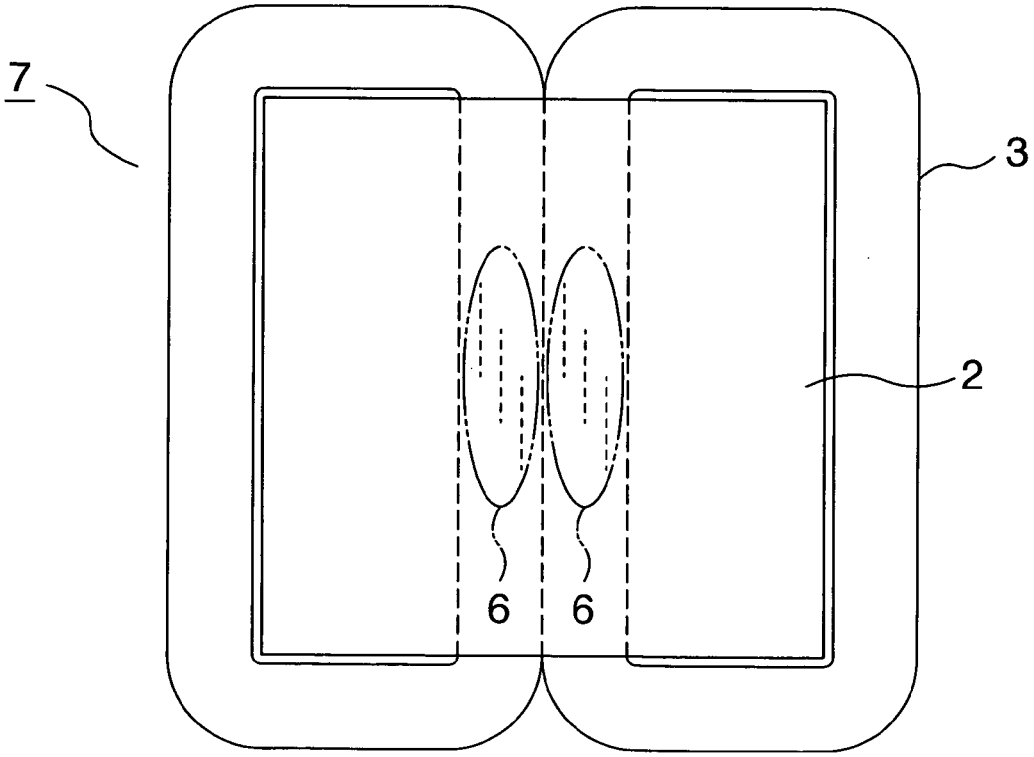
FIG. 8 is an explanatory view of a sixth embodiment of the present invention.

FIG. 8 is an illustration of the relationship between a wound iron core and a coil constituting a transformer according to a sixth embodiment of the present invention.

In FIG. 8, the numeral 7 indicates that the relationship between a coil and a wound iron core is of an outer iron configuration; the numeral 2 denotes an exciting coil; 3 a wound iron core; and 6 a lap portion of the wound iron core. In the sixth embodiment, the lap portion of the iron core is disposed inside the frame of the exciting coil. For this reason, it is difficult to carry out a lapping operation, while it is possible to reduce the height dimension of the iron core by about 5%. In this way, in the fourth embodiment, it is possible to enhance the iron core characteristics and to realize the compactness of the transformer.

Figure 9:
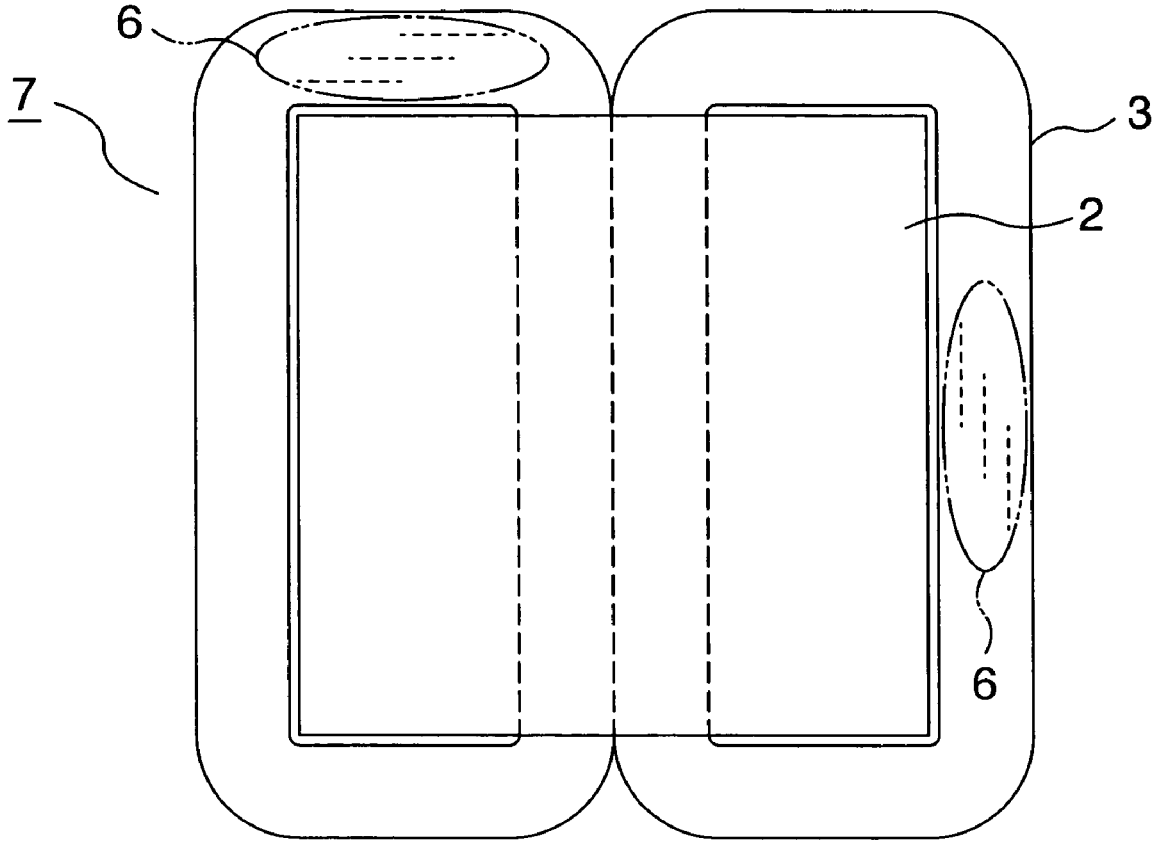
FIG. 9 is an explanatory view of a seventh embodiment of the present invention.

FIG. 9 is an illustration of the relationship between a wound iron core and a coil constituting a transformer according to a sixth embodiment of the present invention.

In FIG. 9, the numeral 7 indicates that the relationship between a coil and a wound iron core is of an outer iron configuration; the numeral 2 denotes an exciting coil; 3 a wound iron core; and 6 a lap portion of the wound iron core. FIG. 9 shows a structure of an outer iron configuration in which a joint area of the iron core on one side is disposed outside the frame of the exciting coil in a direction vertical to a winding direction, and a joint area of the iron core on the other side is disposed on a side face of the coil outside the frame of the exciting coil. In the seventh embodiment, all the lap portions of the wound iron core are disposed outside the frame of the coil, and hence it is easy to carry out a lapping operation.

The first and second embodiments can be also employed in combination with each other.

For example, in the seventh embodiment, the joining structure of the wound iron core of the outer iron configuration on one side is such that one half thereof has a joining structure similar to the joining structure in the first embodiment, and another half is a butt step-lap type. The joining structure of the wound iron core on the other side is similar to the joining structure in the second embodiment. Thus, it is possible to improve the workability and at the same time to reduce the height dimension on one side, leading to the optimization of the workability and the size of the transformer.

Figure 10:
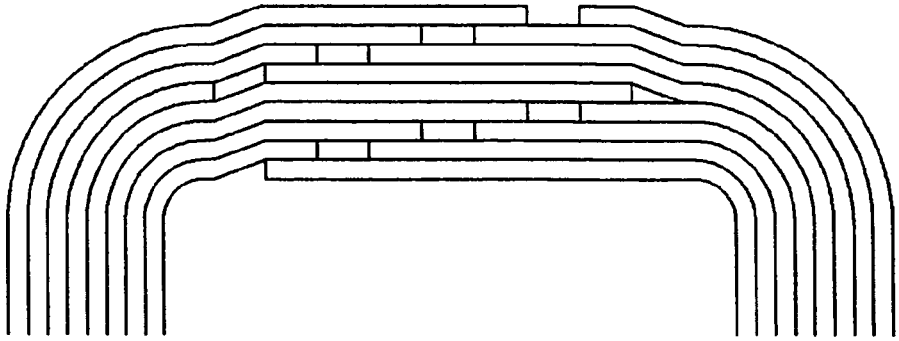
FIG. 10 is an explanatory view of an eighth embodiment of the present invention.

A joining structure according to an eighth embodiment is shown in FIG. 10. This structure is a wound iron core structure in which a part having a lap structure and a part having a butt structure are disposed in the named order from the side of an innermost periphery of the wound iron core. In a case of a specification of an iron core designed at a relatively high magnetic flux density, an uneven distribution of magnetic flux is decreased, and a structure having improved iron core characteristics is provided by disposing a good lap joint area having a magnetic characteristic on an inner peripheral portion having a high magnetic flux density, rather than an effect of uniformization of the distribution of magnetic flux.

Figure 11:
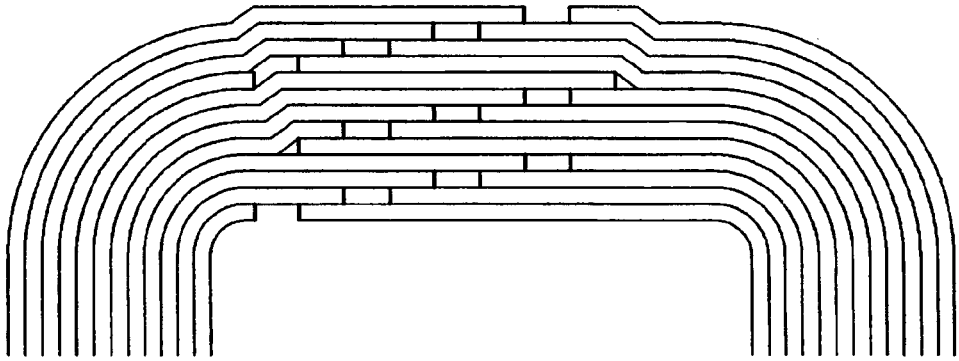
FIG. 11 is an explanatory view of a ninth embodiment of the present invention.

A joining structure according to a ninth embodiment is shown in FIG. 11. This structure is a wound iron core structure in which a part having a butt structure, a part having a lap structure and a part having a butt structure are disposed in the named order from the side of an innermost periphery of the wound iron core. This is a structure in which an innermost peripheral portion of the iron core having a magnetic flux density lower than that of a central portion in a laminating direction is of a butt structure by further finely taking into consideration a distribution of magnetic flux further fine as compared with a structure according to a twelfth embodiment, whereby an increase in thickness of lamination of a joint area is suppressed while maintaining to improve the iron are characteristic, enabling a size of a transformer to lead to a reduction thereof.

Figure 12:
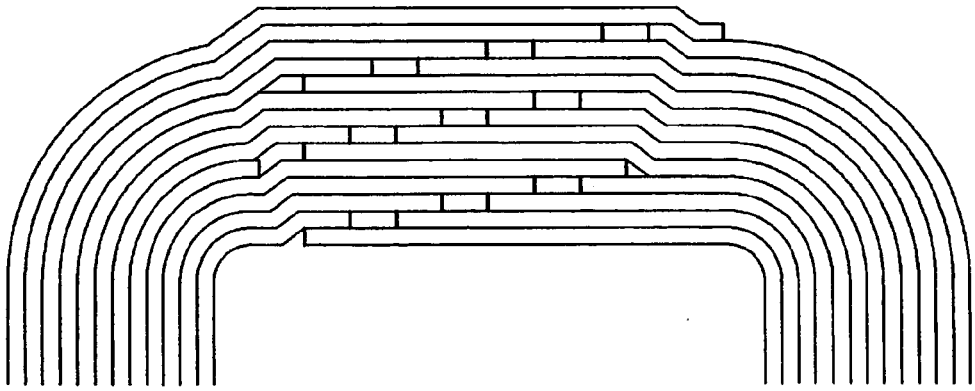
FIG. 12 is an explanatory view of a tenth embodiment of the present invention.

A joining structure of a wound iron core according to a tenth embodiment is shown in FIG. 12. This structure is a wound iron core structure in which a part having a lap structure, a part having a butt structure and a part having a lap structure are disposed in the named order from the side of an innermost periphery of the wound iron core. This is a structure in which the iron core characteristics are improved by uniformly distributing the magnetic flux, because the magnetic flux is distributed largely unevenly, when a uniformly jointing structure is provided at a specification of an iron core designed at a relatively low magnetic flux density.

Figure 13:
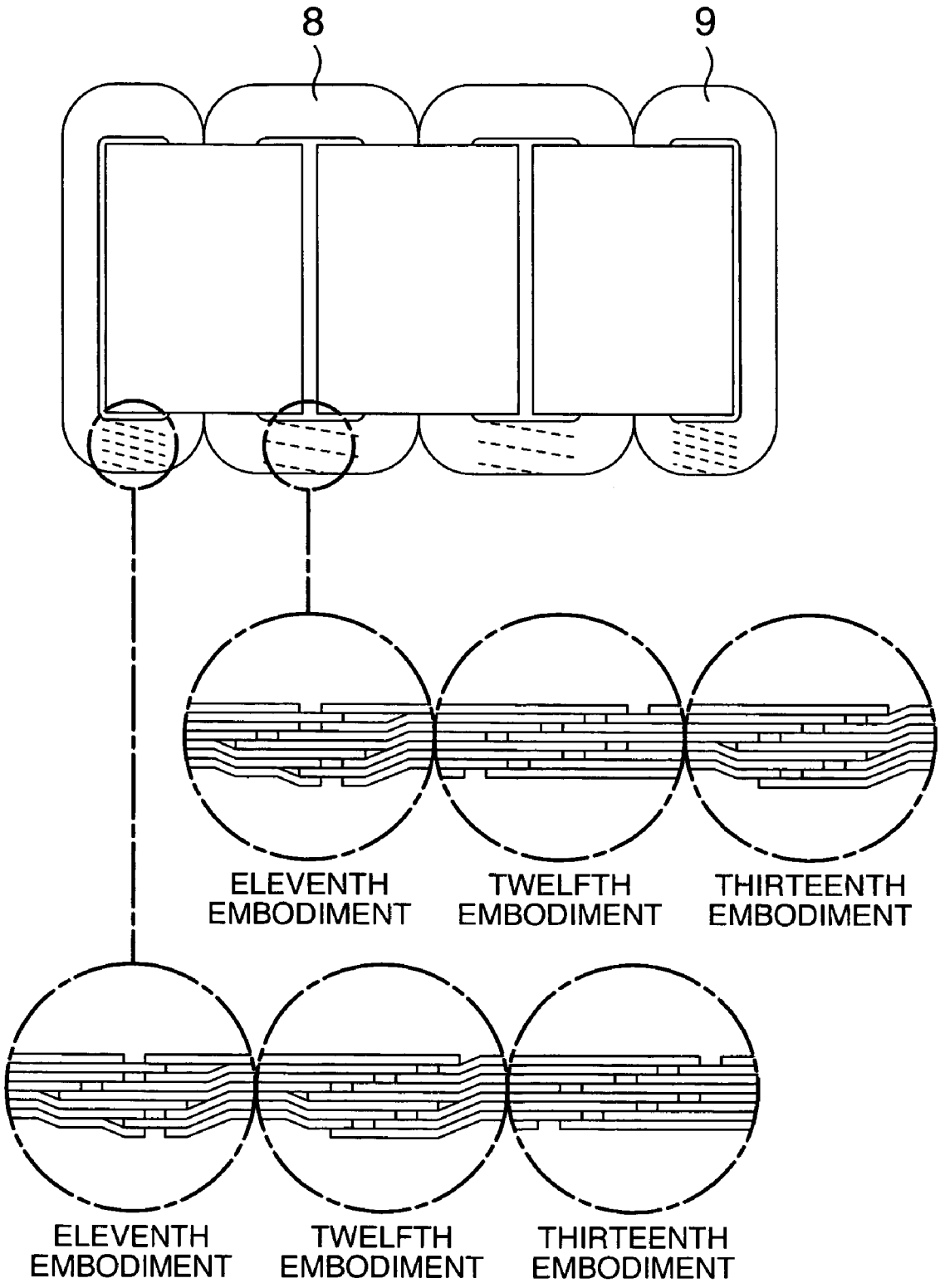
FIG. 13 is an explanatory view of eleventh, twelfth and thirteenth embodiments of the present invention.
Figure 14:
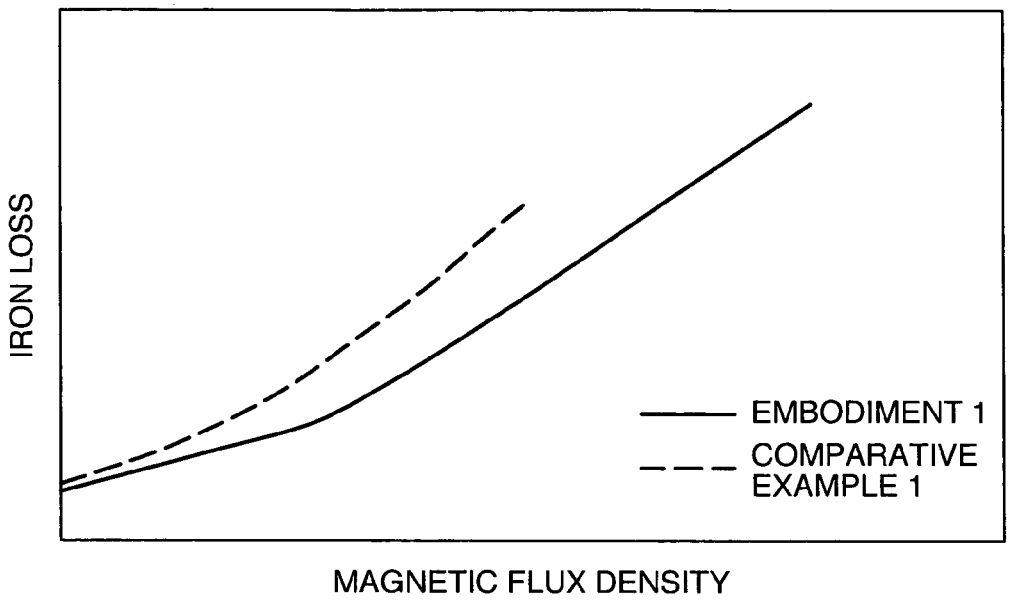
FIG. 14 is a diagram for explaining the eleventh embodiment of the present invention.
Figure 16:
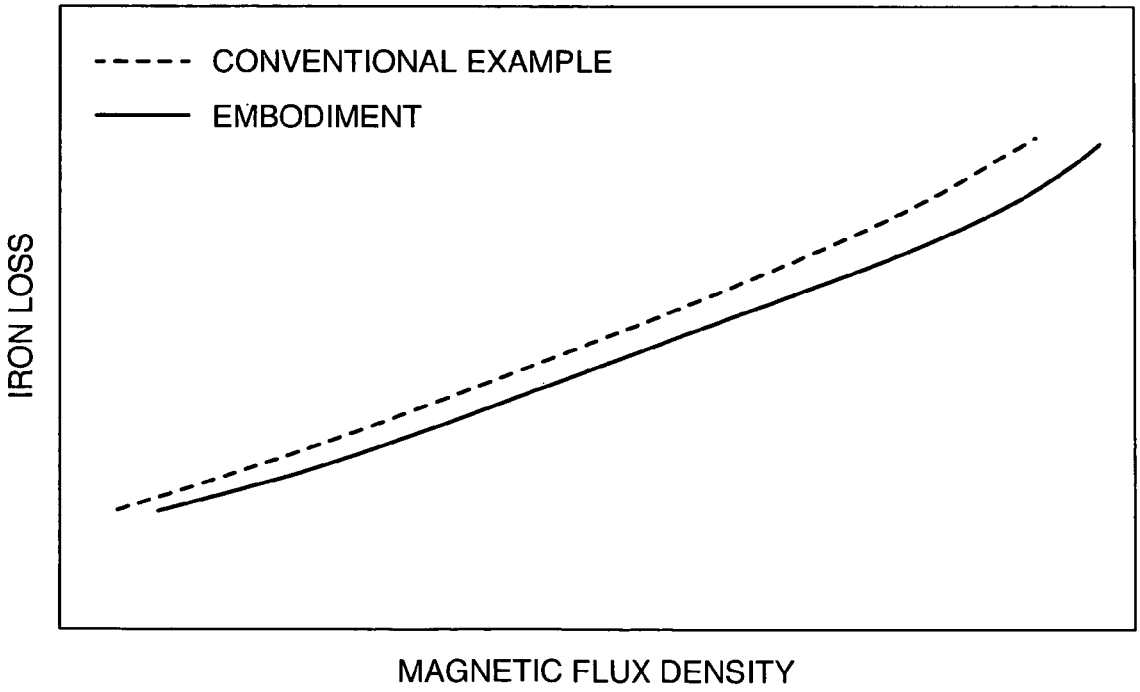
FIG. 16 is a diagram for explaining the fourteenth embodiment of the present invention.

Further, a three-phase and five-leg iron core structure according to an eleventh embodiment is shown in FIG. 13. In the structure according to the eleventh embodiment, a portion of the inside of each iron core is of a lap joining configuration and the remaining portion is of a butt joining configuration. In this case, all the iron cores may be of the same structure. This structure is such that the iron core characteristics are improved by uniformizing the magnetic flux density in each of the iron cores. This is effective when the unevenness of the magnetic flux density within the iron core is larger. An iron loss in the eleventh embodiment is shown in FIG. 14. A comparative example in which all joint areas are of a butt joining configuration is also shown in FIG. 14. It can be seen that the iron core characteristics in the eleventh embodiment have been improved particularly at a high magnetic flux density.

A twelfth embodiment provides for an iron core structure in which an outer iron core 5 is of a lap joining configuration and an inner iron core 4 is of a butt joining configuration, as shown in FIG. 13. In this case, the magnetic flux density is uniformized to improve the iron core characteristics by increasing the effective sectional area using the lap joining configuration in the outer iron core 5 having a relatively low magnetic flux density. In this structure, the improvement of characteristics is provided in a high magnetic density design.

A thirteenth embodiment provides for an iron core structure in which an inner iron core 4 is of a lap joining configuration and an outer iron core 5 is of a but joining configuration, as shown in FIG. 13. In this case, the improvement of iron core characteristics is provided by using the lap joining configuration having a good magnetic characteristic in the inner iron core 4 having a high magnetic flux density. In this structure, the improvement of characteristics is provided in a low magnetic density design.

Figure 15:
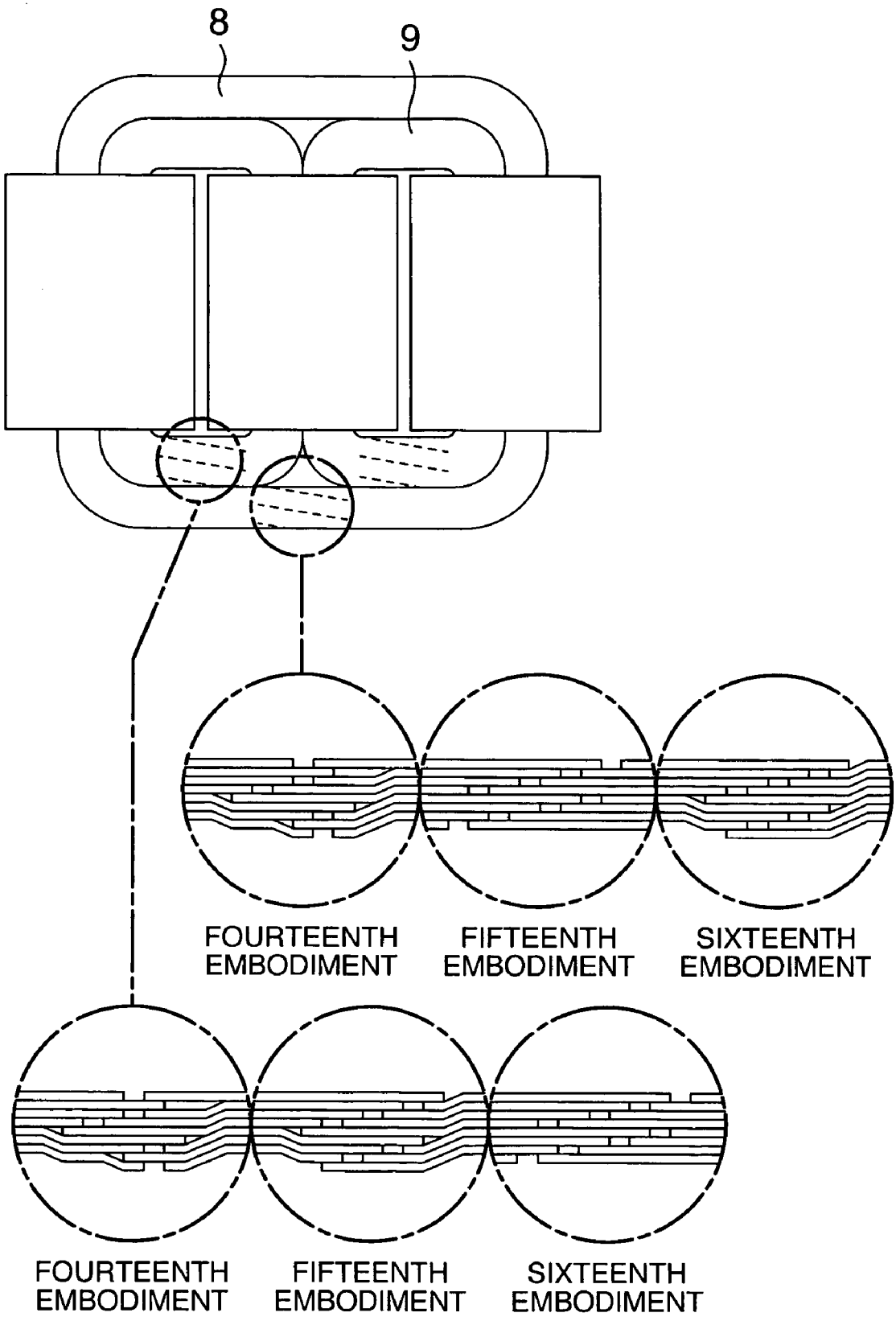
FIG. 15 is an explanatory view of fourteenth, fifteenth and sixteenth embodiments of the present invention.

A three-phase and three-leg iron core structure according to a fourteenth embodiment is shown in FIG. 15. In the structure according to the fourteenth embodiment, a portion of the inside of each iron core is of a lap joining configuration and the remaining portion is of a butt joining configuration. In this case, all the iron cores may be of the same structure. This structure is such that the iron core characteristics are improved by uniformizing the magnetic flux density in each of the iron cores. This is effective when the unevenness of the magnetic flux density within the iron core is larger.

A fifteenth embodiment provides for an iron core structure in which an outer iron core 5 is of a lap joining configuration and an inner iron core 4 is of a butt joining configuration, as shown in FIG. 15. In this structure, the magnetic flux density is uniformized to improve the iron core characteristics by increasing the effective sectional area using the lap joining configuration in the outer iron core 5 having a relatively low magnetic flux density. In this structure, the improvement of characteristics is provided in a high magnetic density design.

A sixteenth embodiment provides for an iron core structure in which an inner iron core 4 is of a lap joining configuration and an outer iron core 5 is of a butt joining configuration, as shown in FIG. 15. In this structure, the iron core characteristics are improved by using the lap joining configuration having a good magnetic characteristic in the inner iron core 4 having a relatively high magnetic flux density. In this structure, the improvement of characteristics is provided in a low magnetic density design.

In this manner, according to the present invention, by changing the disposition of the lap areas and the rate of the joining structures in accordance with the capacity and specification of the transformer, it is possible not only to enhance the characteristics of the wound iron core but also to adjust the workability and the mutual balance of the iron core characteristics and the size of the transformer and to realize the optimization of the cost.

The plate-shaped magnetic material for forming the wound iron core according to the present invention is not limited an amorphous thin band material and a silicone steel plate, and may be another magnetic material.

The strain of the magnetic flux waveform due to the concentration of the magnetic flux can be suppressed by uniformizing the magnetic resistance within the iron core using the above-described measure, leading to an enhancement in iron core characteristics.

While the trendy of the preservation of a global environment is activated socially, it is desired to provide a low-loss appliance with regard to an electric distribution device, and the applicability of the present invention is very high.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A transformer comprising at least one interlinking, exciting coil, and an iron core inserted into said coil and formed annularly into a plurality of layers from a plate-shaped magnetic material, said iron core being of an inner and/or outer iron configuration, wherein the iron core is arranged to make one or more of the layers of plate-shaped magnetic material forming said iron core offset in a winding direction, opposite ends of each layer having a joint portion provided by lapping on each other, said joint portion is provided inside or outside a frame of said exciting coil, said joint portion of the opposite ends of some of said layers increase with respect to a length of said lapping thereof from the innermost layer to the outermost layer.

2. A transformer according to claim 1, wherein said iron core is of an inner iron configuration in which a joint area is outside a frame of the exciting coil.

3. A transformer according to claim 1, wherein said iron core is of an inner iron configuration in which a joint area is inside the frame of the exciting coil.

4. A transformer according to claim 1, wherein said iron core is of an outer iron configuration in which a joint area is outside the frame of the exciting coil.

5. A transformer according to claim 1, wherein said iron core is of an outer iron configuration in which a joint area is inside the frame of the exciting coil.

6. A transformer according to claim 1, wherein said iron core is of an outer iron configuration in which a joint area on one side is outside the frame of the exciting coil, and a joint area on the other side is inside the frame of the exciting coil.

* * * * *